US005967422A

United States Patent [19]

Wang

[11] Patent Number: 5,967,422

[45] Date of Patent: Oct. 19, 1999

[54] WATER AMOUNT CONTROLLING SWITCH STRUCTURE OF WATER INJECTION GUN

[75] Inventor: King-Yuan Wang, Changhua Hsien, Taiwan

[73] Assignee: Yuan Mei Corp., Changhua Hsien, Taiwan

[21] Appl. No.: 09/096,291

[22] Filed: Jun. 12, 1998

[51] Int. Cl.[6] ..... B05B 1/12

[52] U.S. Cl. ..... 239/526

[58] Field of Search ..... 251/102, 103, 251/110; 239/526, 525, 569, 583

[56] References Cited

U.S. PATENT DOCUMENTS

| | | | |
|---|---|---|---|
| 789,795 | 5/1905 | Cheney | 251/103 |
| 1,206,320 | 11/1916 | Gifler | 251/103 |
| 5,662,273 | 9/1997 | Chih | 239/526 |

FOREIGN PATENT DOCUMENTS

| | | | |
|---|---|---|---|
| 154091 | 9/1985 | European Pat. Off. | 239/526 |

*Primary Examiner*—Kevin Weldon
*Attorney, Agent, or Firm*—Bacon & Thomas

[57] ABSTRACT

A water amount controlling switch structure of water injection gun, including a gun housing, a controlling pin, a water sealing gasket, a filter screen, a water sealing washer, an adjustment pin, a trigger, a push button and a large and a small springs. The controlling pin is two-stepped. A small diameter section thereof is formed with a conic head at end portion. The step section of the controlling pin is disposed with an annular engaging slope face. The large diameter section of the controlling pin is disposed with four vanes at equal intervals. The adjustment pin is T-shaped, having a water sealing ring inserted with tail end thereof. The tail end is formed with a conic head. The trigger is U-shaped and an upper section of a middle board thereof is disposed with a push button notch. A lower edge of the notch is formed with a supporting slope face. The inner side of the push button is disposed with a projecting hollow fitting post. The bottom of the push button is disposed with a micro-adjustment slope face. Two sides of the slope face are respectively formed with two slits defining therebetween a resilient pushing section. The end of the resilient pushing section is disposed with a short horizontal section and a triangular engaging guide edge connecting therewith.

3 Claims, 6 Drawing Sheets

WATER AMOUNT CONTROLLING SWITCH STRUCTURE OF WATER INJECTION GUN

BACKGROUND OF THE INVENTION

The present invention relates to a water amount controlling switch structure of water injection gun, which can easily and quickly micro-adjust the water amount or shut off the water as necessary. In addition, the trigger of the switch structure can be smoothly pressed so as to more accurately micro-adjustably discharge the water.

In the conventional water injection gun, the water flow is controlled by a front trigger type controlling switch. Such controlling switch can only keep a maximum water amount or shut off the water . while failing to micro-adjust water amount as necessary. This often leads to inconvenience in use of the water injection gun.

SUMMARY OF THE INVENTION

It is therefore a primary object of the present invention to provide a water amount controlling switch structure of water injection gun, which is able to micro-adjust the water amount as necessary.

It is a further object of the present invention to provide the above water amount controlling switch structure in which the micro-adjustment and shutting off of the water flow can be easily performed only by directly pressing the trigger or the push button.

It is still a further object of the present invention to provide the above water amount controlling switch structure in which a bottom edge of the push button is formed with a micro-adjustment slope face and two sides of the slope face are respectively formed with two slits defining therebetween a resilient pushing section. An end of the resilient pushing section is disposed with a short horizontal section and a triangular engaging guide edge connecting therewith. By means of the guide edge, the push button can be easily assembled with the trigger.

It is still a further object of the present invention to provide the above water amount controlling switch structure in which by means of the engagement between the supporting slope face of the trigger and the micro-adjustment slope face and resilient pushing section of the push button, the trigger can be smoothly pressed inward and freely located to more accurately micro-adjustably discharge the water.

The present invention can be best understood through the following description and accompanying drawings, wherein:

DETAILED DESCRIPTION OF THE PREFERRED EMBODIMENT

Figure 1:
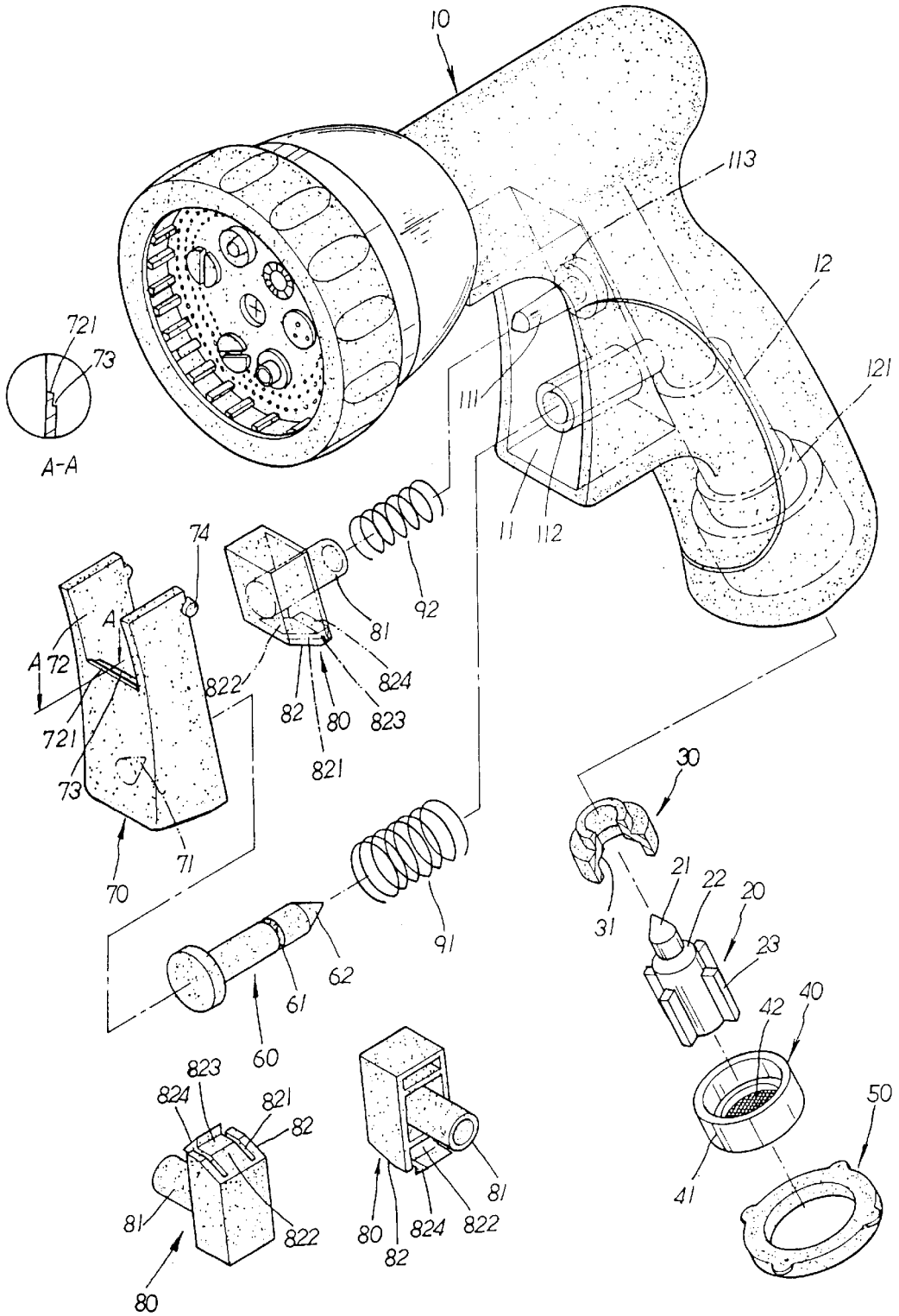
FIG. 1 is a perspective exploded view of the present invention.

Please refer to FIG. 1. The present invention includes a gun housing 10 a controlling pin 20, a water sealing gasket 30, a filter screen 40, a water sealing washer 50, an adjustment pin 60, a trigger 70, a push button 80 and a large and a small springs 91, 92. The housing 10 has a grip an inner side of which is formed with a chamber 11. An upper portion of the bottom of the chamber 11 is disposed with a stepped post 111. A lower portion of the bottom of the chamber is disposed with a hollow post 112. An upper end portion of the lateral wall of the chamber is formed with a pivot recess 113. The grip is formed with an internal three-stepped water way 12. A lower end portion of the middle diameter section of the water way 12 is formed with an insertion groove 121. A lower portion of the small diameter section of the water way is formed with a pin hole 122 communicating with the hollow post 112 of the chamber 11. The controlling pin 20 is two-stepped. A small diameter section thereof is formed with a conic head 21 at end portion. The step section of the controlling pin is disposed with an annular engaging slope face 22. The large diameter section of, the controlling pin is disposed with four vanes 23 at equal intervals. The water sealing gasket 30 is two-stepped. The inner step portion thereof is disposed with a water sealing slope face 31. The filter screen 40 includes a ring body 41 and a screen mesh 42 disposed at bottom end of the ring body 41. The adjustment pin 60 is T-shaped, having a water sealing ring 61 inserted with tail end thereof. The tail end is formed with a conic head 62. The trigger 70 is a U-shaped member. A middle board thereof is disposed with a conic pushing post 71 projecting from lower portion of inner side. An upper portion of the middle board is formed with a push button notch 72. A lower edge of the push button notch 72 is formed with a supporting slope face 721. The lower edge of the notch 72 on inner side of the middle board is disposed with a transverse insertion channel 73. The rear corner of upper end of each lateral wall of the trigger is disposed with an outward extending boss 74. The inner side of the push button 80 is disposed with a projecting hollow fitting post 81. The bottom of the push button is disposed with a micro-adjustment slope face 82. Two sides of the slope face 82 are respectively formed with two slits 821 defining therebetween a resilient pushing section 822. The end of the resilient pushing section 822 is disposed with a short horizontal section 823 and a triangular engaging guide edge 824 connecting therewith.

Figure 2:
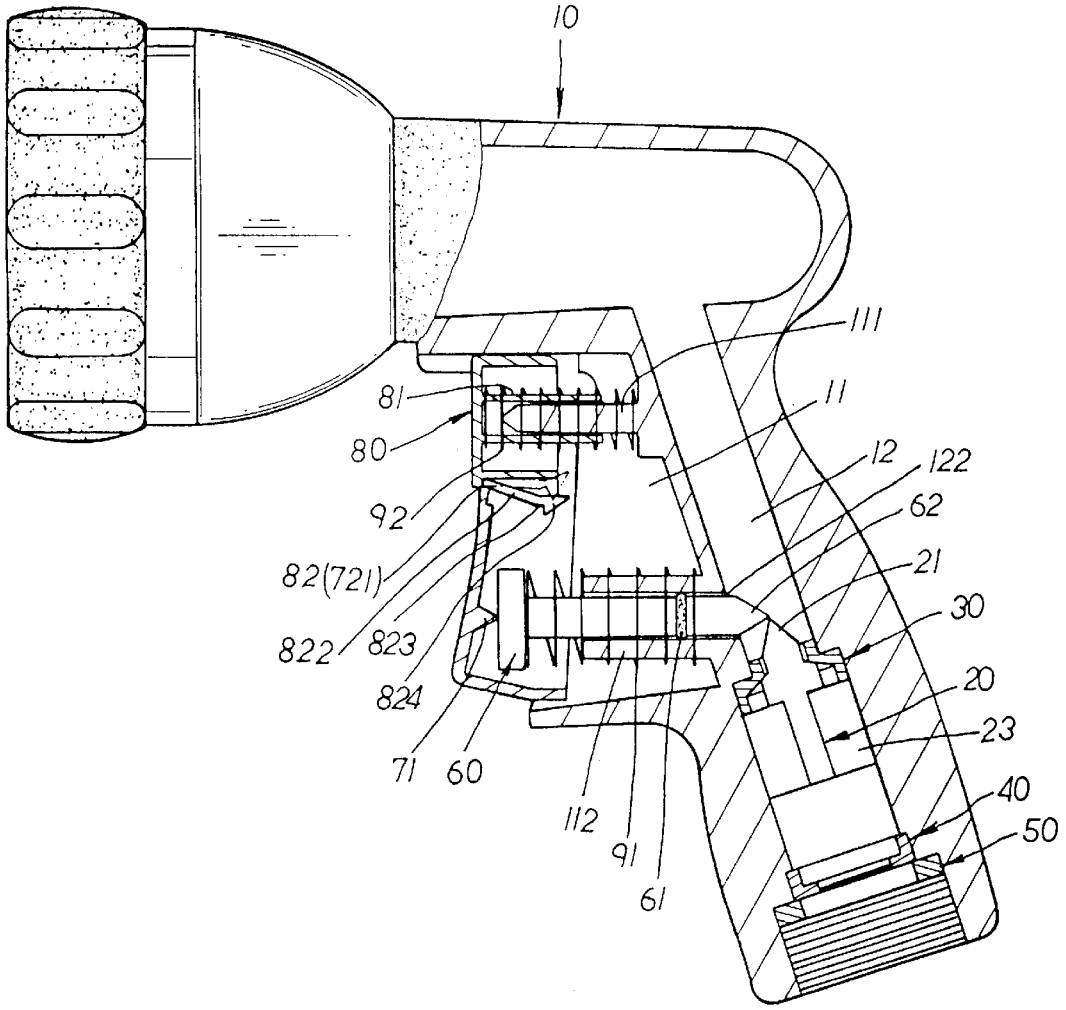
FIG. 2 is a sectional assembled view of the present invention.
Figure 3:
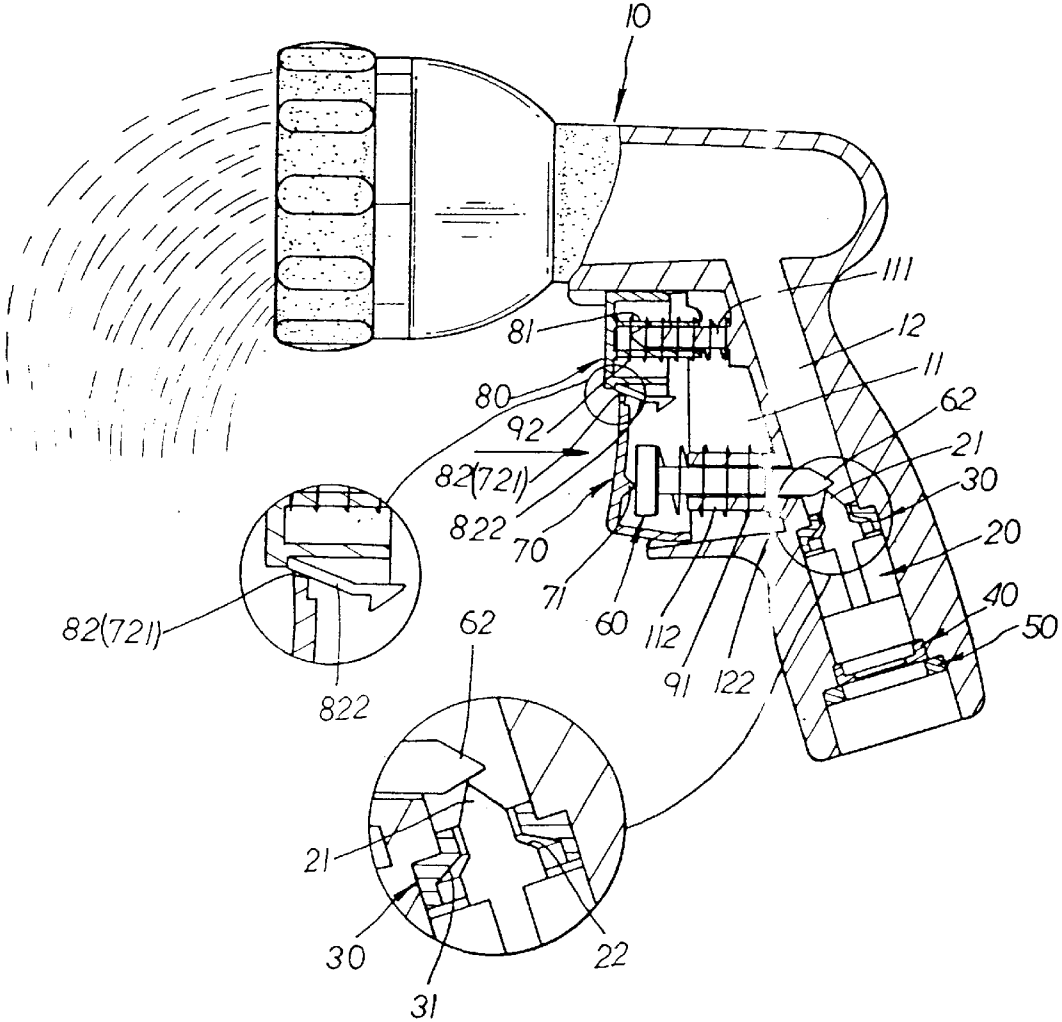
FIG. 3 is a view according to FIG. 2 showing the water injection gun of the present invention in a micro-amount discharging state.
Figure 4:
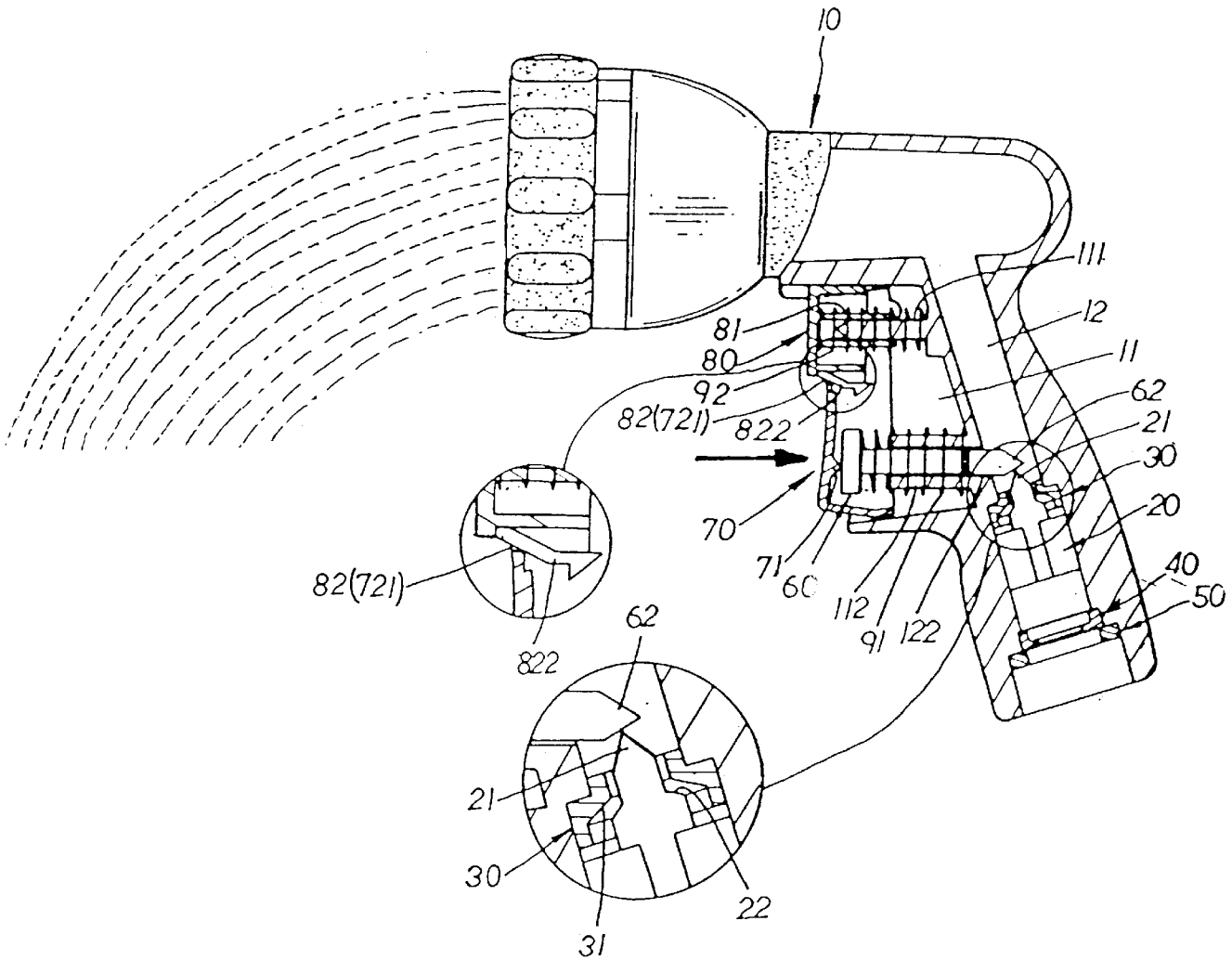
FIG. 4 is a view according to FIG. 2, showing the water injection gun of the present invention in a small amount discharging state.
Figure 5:
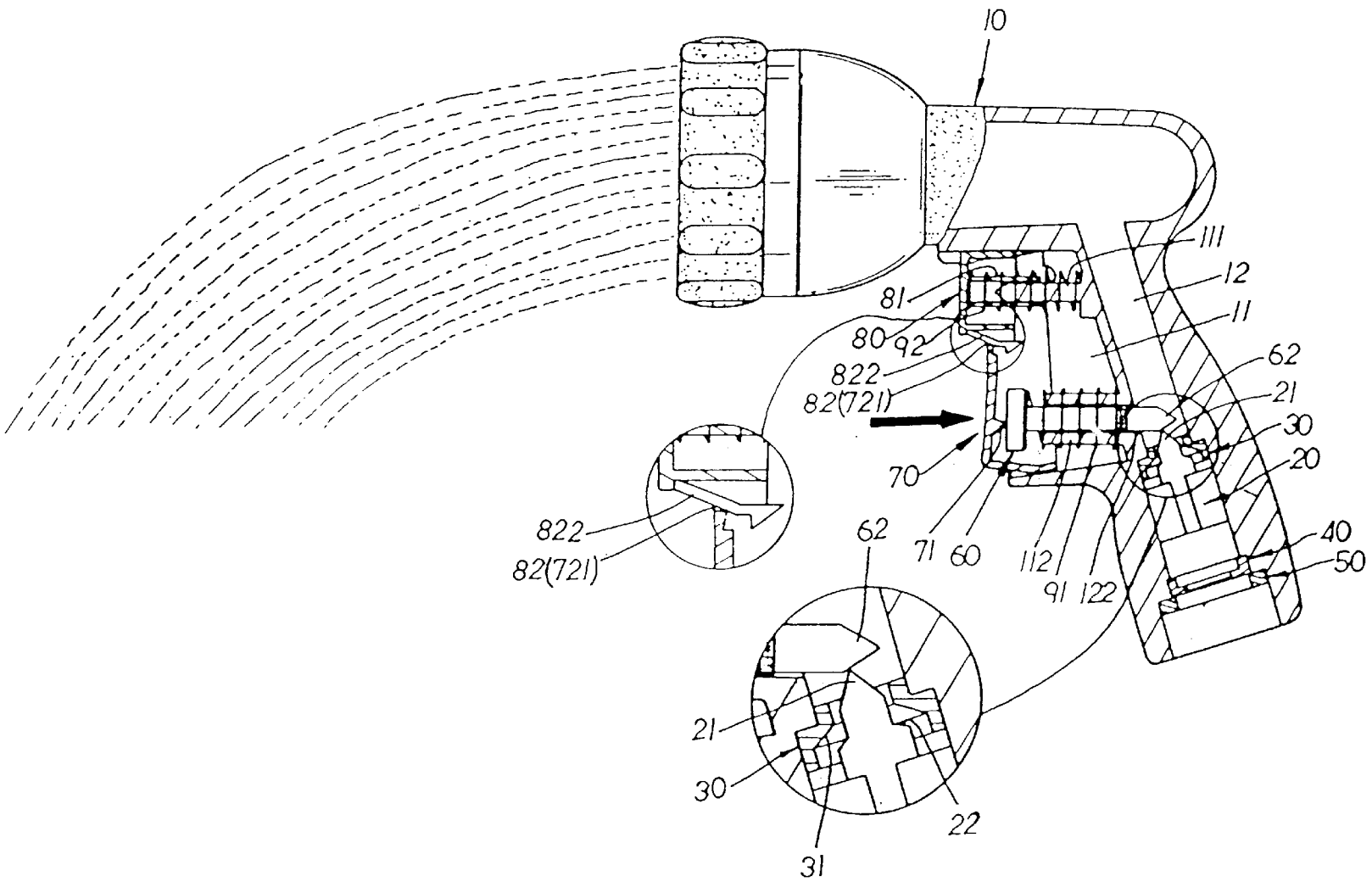
FIG. 5 is a view according to FIG. 2, showing the water injection gun of the present invention in a middle amount discharging state.
Figure 6:
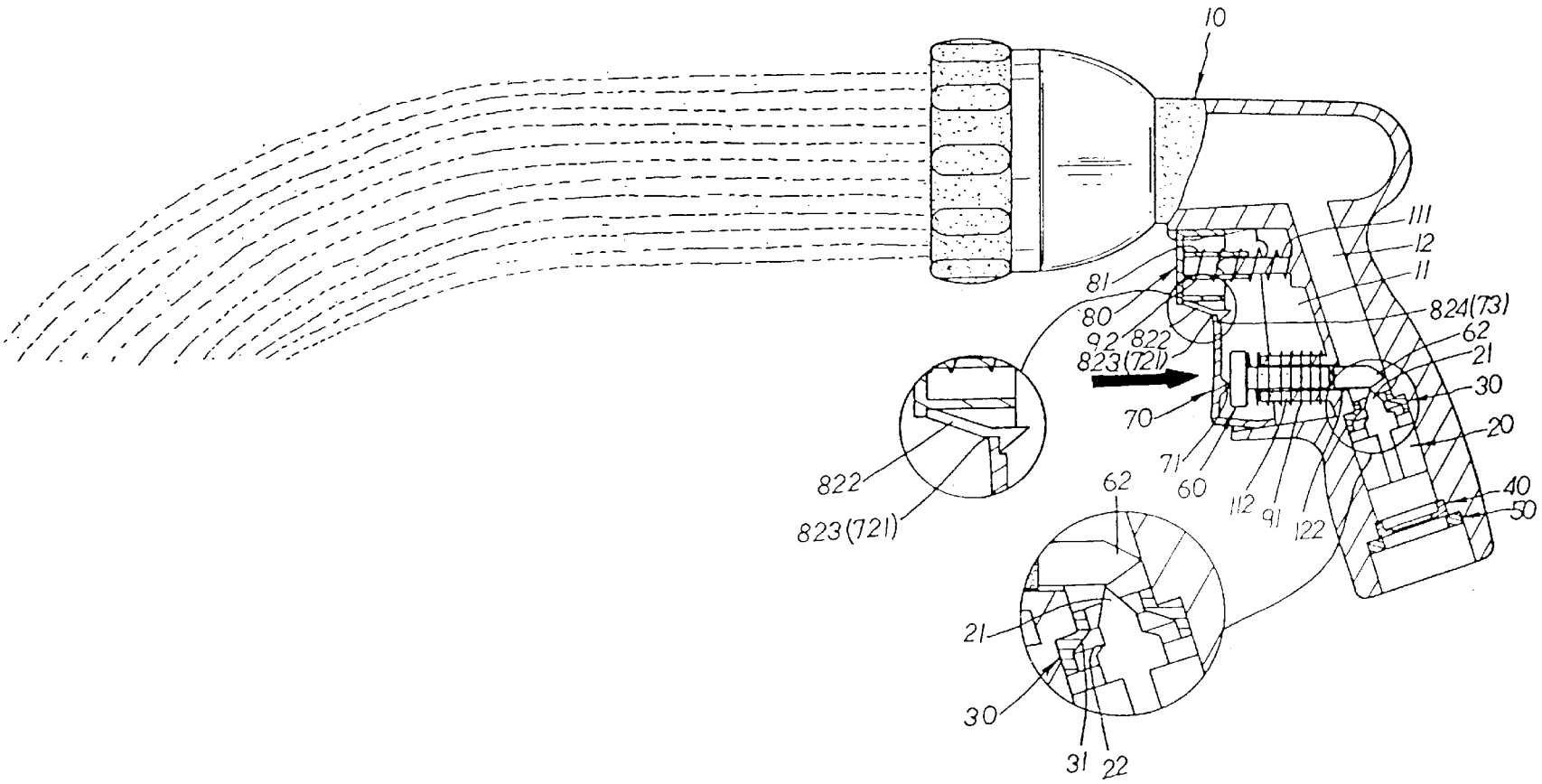
FIG. 6 is a view according to FIG. 2, showing the water injection gun of the present invention in a maximum amount discharging state.

Please refer to FIG. 2. When assembled, the water sealing gasket 30 is fitted into the water way 12 of the gun housing 10 to tightly engage with the step between the small and middle diameter portions. The controlling pin 20 is fitted into the water way 12 and received in the middle diameter section thereof. The four vanes 23 of the controlling pin abut against the inner edge of,the middle diameter section of the water way 12, whereby by means of hydraulic force, the slope face 22 of the controlling pin 20 is forced to upward engage with the water sealing slope face 31 of the water sealing gasket 30. At this time, the conic head 21 of the controlling pin 20 extends through the water sealing gasket 30 into the small diameter portion of the water way 12 of the gun housing 10. The filter screen 40 is then tightly fixedly fitted into the insertion groove 121 of the water way 12. The water sealing washer 50 is fitted into a thread socket of the housing 10. The large spring 91 is fitted around the hollow post 112 of the chamber 11 of the housing 10. The adjustment pin 60 is fitted into the hollow post 112 of the chamber 11 with the enlarged head section thereof resiliently compressing the large spring 91. The trigger 70 is fitted into the chamber 11 of the gun housing 10. The bosses 74 of the trigger 70 are resiliently pivotally inserted in the pivot holes 113 of the gun housing 10. At this time, the tip of the conic head pushing post 71 of the trigger 70 abuts against the end face of the adjustment pin 50. The small spring 92 is fitted around the hollow fitting post 81 of the push button 80 with one end abutting against the inner side face of the push button 80. Then the trigger 70 is pressed to easily fit the push button 80 into the notch 72 of the trigger 70 via the triangular engaging guide edge 824 of the resilient pushing section 822. The other end of the small spring 92 abuts against the end face of the large diameter step of the stepped post 111 of the chamber 11. At this time, the micro-adjustment slope face 82 of the push button 80 is attached to the supporting slope face 721 of the notch 72 of the trigger 70.

Please refer to FIGS. 3, 4, 5 and 6 which respectively show micro-amount discharge, small amount discharge, middle amount discharge and maximum amount discharge of the present invention. When operated, the trigger 70 is slowly pressed toward the chamber 11 of the gun housing 10, whereby the supporting slope face 721 of the trigger 70 is inward pivoted. Accordingly, the push button 80 is resiliently moved outward by the small spring 92, while the micro-adjustment slope face 82 of the push button 80 is kept leaning against the supporting slope face 721 of the trigger 70. Simultaneously, the conic pushing post 71 of the trigger 70 inward pushes the adjustment pin 60 and compresses the large spring 91. Further, the conic face of the conic head 62 of the adjustment pin 60 downward depresses the tip of the conic head 21 of the controlling pin 20, making the engaging slope face 22 of the controlling pin 20 separate from the water sealing slope face 31 of the water sealing gasket 30. Therefore, the water can flow and filter through the filter screen 40 and flow through the gap between the engaging slope face 22 and the water sealing slope face 31 to be discharged from, the gun housing. When the water flow reaches the necessary amount, the trigger 70 is released. At this time, on one hand the conic pushing post 71 of the trigger 70 is resiliently pushed by the large spring 91 and on the other hand the supporting slope face 721 of the notch 72 is leant against and engaged with the micro-adjustmerit slope face 82 and resilient pushing section 822 of the push button 80. Therefore, the trigger 70 is located and makes the injection gun discharge water at constant amount.

When it is desired to keep a maximum water amount, the trigger 70 is pressed toward the chamber 11 to the bottom. At this time, the supporting slope face 721 of the trigger 70 is leant against and engaged with the horizontal section 823 of the resilient pushing section 822 of the push button 80 and the triangular engaging guide edge 824 of the resilient pushing section 822 is engaged with the insertion channel 73 of the trigger 70. Also, the large diameter portion of the conic head 62 of the adjustment pin 60 presses the tip of the conic head 21 of the controlling pin 20. At this time, the engaging slope face 22 of the controlling pin 20 is maximum separated from the water sealing slope face 31 of the water sealing gasket 30 so as to keep a maximum water amount.

Reversely, when it is desired to shut off the water, the push button 80 is pressed toward the chamber 11, whereby a gap is formed between the micro-adjustment slope face 82 and the supporting slope face 721. At this time, the trigger 70 is outward pivoted by the large spring 91 to keep the supporting slope face 721 leaning against the micro-adjustment slope face 82 and the resilient pushing section 822. Accordingly, the conic pushing post 71 of the trigger 70 is moved outward and the adjustment pin 60 is resiliently outward restored to its home position by the large spring 91. Also, the controlling pin 20 is resiliently moved upward to its home position by the hydraulic force, whereby the engaging slope face 22 is engaged with the water sealing slope face 31 to shut off the water.

According to the above arrangement, the present invention has the following advantages:

1. The water amount can be micro-adjusted as necessary.
2. The micro-adjustment and shutting off of the water flow can be easily performed.
3. The push button 80 can be easily installed into the notch 72 of the trigger 70 via the engaging guide edge 824 of the resilient pushing section 822.
4. By means of the resilient pushing section 822 of the micro-adjustment slope face 82 of the push button 80, the trigger 70 can be more smoothly pressed so as to more accurately micro-adjustably discharge the water.

The above description and accompanying drawings are only used to illustrate one embodiment of the present invention. Any modification or variation derived from the embodiment should fall within the scope of the present invention.

What is claimed is:

1. A water amount controlling switch structure of water injection gun, the injection gun having a gun housing, the gun housing having a grip in which a three-stepped water way is formed, a water sealing gasket being fitted with a step portion between a small and a middle diameter portions of the water way, a controlling pin being fitted in the water sealing gasket and resiliently upward pushed by a spring, an inner side of the grip being formed with a chamber, a stepped post and a hollow post being respectively disposed on upper and lower sections of a bottom of the chamber, an adjustment pin being fitted in the hollow post and outward pushed by a spring, a conic face of a conic head of the adjustment pin downward pressing a tip of a conic head of the controlling pin so as to change the gap between an engaging slope face of the controlling pin and a water sealing slope face of the water sealing gasket and thus control water amount, said controlling switch structure being characterized in that a U-shaped trigger is pivotally connected with an opening of the chamber of the gun housing, a lower portion of inner side of a middle board of the trigger being disposed with a projecting conic pushing post for abutting against an end face of the adjustment pin, an upper section of the middle board being disposed with a push button notch, a lower edge of the notch being formed with a supporting slope face, a transverse insertion channel being formed on lower edge of the notch on inner side of the middle board, a push button being received in the notch, an upper section of inner side of the push button being disposed with a hollow fitting post, the hollow fitting post being resiliently pushed by a spring fitted on the stepped post of the chamber, a bottom edge of the push button being formed with a micro-adjustment slope face leaning against and engaging with the supporting slope face of the notch of the trigger, two sides of the slope face being respectively formed with two slits defining therebetween a resilient pushing section, an end of the resilient pushing section being disposed with a short horizontal section and a triangular engaging guide edge connecting therewith, whereby by means of the guide edge, the push button can be easily installed into the notch of the trigger and by means of the engagement between the supporting slope face of the trigger and the micro-adjustment slope face and resilient pushing section of the push button, the trigger can be smoothly pressed inward and freely located to micro-adjust the water amount, by means of pressing back the push button, the trigger being restored to its home position to shut off the water.

2. A water amount controlling switch structure as claimed in claim 1, wherein the controlling pin is two-stepped and a large diameter section of the controlling pin is disposed with several vanes at equal intervals, the vanes attaching to inner edge of the middle diameter step of the water way of the housing for guiding the vertical movement of the controlling pin.

3. A water amount controlling switch structure as claimed in claim 1, wherein the adjustment pin is T-shaped, having a water sealing ring inserted with a tail end thereof.

* * * * *